US005109570A

United States Patent [19]

Okada et al.

[11] Patent Number: 5,109,570

[45] Date of Patent: May 5, 1992

[54] OPENING/CLOSING MECHANISM

[75] Inventors: Shigeru Okada; Masami Fujita, both of Tokyo, Japan

[73] Assignees: Tofuji E.M.I. Co., Ltd., Tokyo; Matsushita Electric Industrial Co., Ltd., Osaka, both of Japan

[21] Appl. No.: 665,420

[22] Filed: Mar. 6, 1991

[51] Int. Cl.[5] ..... E05F 1/08

[52] U.S. Cl. ..... 16/289; 16/247; 16/342; 16/337

[58] Field of Search ..... 16/289, 278, 375, 376, 16/337, 342, 257, 260, 265, 286, 297

[56] References Cited

U.S. PATENT DOCUMENTS

| | | | |
|---|---|---|---|
| 2,183,210 | 12/1939 | Anderson | 16/278 |
| 3,117,827 | 1/1964 | Cecala | 16/275 |
| 4,408,799 | 10/1983 | Bowman | 16/342 |
| 4,730,364 | 3/1988 | Tat-Kee | 16/337 |
| 5,031,270 | 7/1991 | Lee | 16/342 |

*Primary Examiner*—Lowell A. Larson
*Assistant Examiner*—Michael J. McKeon
*Attorney, Agent, or Firm*—Koda and Androlia

[57] ABSTRACT

An opening/closing mechanism is used in apparatus such as personal computers, word processors and liquid-crystal televisions, some of these apparatus. The opening/closing mechanism comprises: a base (10) attached to a main body (20) of an apparatus; an arm (18) attached to an opening/closing portion (21) of the apparatus and axially supported on the base (10) so as to turn freely; a rotary plate (12, 13) which turns together with the arm (18) and which has a projection (13*d*); a pop-up plate (14) having an engaging portion (14*b*, 14*c*), wherein when the opening/closing portion (21) is closed up to a prescribed position, the engaging portion, (14*c*) engages with the projection (13*d*) of the rotary plate so that the pop-up plate turns together with the rotary plate (13); and a resilient member (19) provided between the pop-up plate (14) and the base (10) and compressed by turning of the pop-up plate (14), wherein when the opening/closing portion (21) is released, the rotary plate (13) is turned together with the pop-up plate (14) by a compressive reaction force, thereby opening/closing portion (21) up to a prescribed position.

6 Claims, 4 Drawing Sheets

OPENING/CLOSING MECHANISM

DETAILED DESCRIPTION OF THE INVENTION

1. Field of the Invention

This invention relates to an opening/closing mechanism in an apparatus having a main body for performing an input operation and an opening/closing portion serving as a display.

2. Prior Art

In apparatus such as personal computers, word processors and liquid-crystal televisions, some of these apparatus long available on the market have an opening/closing portion, such as a display panel folded onto a main body in order to make the apparatus portable.

In order to make it easy to set upright the opening/-closing portion, the arrangement is such that the opening/closing portion opens slightly when this portion is released. Further, it is so arranged that it is not possible to close the opening/closing portion completely unless this portion is pressed, when the opening/closing portion is closed. This arrangement prevents the opening/-closing portion and the main body from striking.

A conventional apparatus of this kind thus constructed employs an opening/closing mechanism shown in FIG. 11.

A base 1 shown in FIG. 11 is attached to the main body of an apparatus. A shaft 2 is supported by the base 1 so as to turn freely. Further, the opening/closing portion of the apparatus, a cam 3, and a coil spring 4 are attached to the shaft 2.

The shaft 2 and cam 3 rotate in the direction of arrow A when the opening/closing portion is opened, and in the direction of arrow B when the opening/closing portion is closed.

When a projection 3*a* formed on the cam 3 is at a position where it abuts against an end portion 4*a* of the coil spring 4, as shown in FIG. 11, the opening/closing portion is in a slightly open state.

If the opening/closing portion is now pushed to turn the shaft 2 and cam 3 further in the direction of arrow B, the coil spring 4 is urged. When the opening/closing portion is released under these conditions, the cam 3 is rotated in the direction of arrow A by the force of the coil spring 4 and comes to rest in the state shown in FIG. 11. In other words, the opening/closing portion pops up by opening slightly at this time.

In general, a strong spring is necessary in order to raise an opening/closing portion such as the display portion of a personal computer. Consequently, the wire diameter of the coil spring 4 in the above-described opening/closing mechanism must be enlarged and the spring itself must be made large in size. In the prior art, therefore, a problem is that the overall opening/closing mechanism is large in size.

In particular, when the opening/closing portion is opened in the example of the prior art, the coil spring 4 limits the turning of the shaft so that the position of the opening/closing portion is maintained. Thus, the coil spring 4 is used for maintaining the position of the opening/closing portion and getting pop-up action. For this reason, there is a limitation upon the placement of the spring and the wire diameter, and it is difficult to reduce the size of the mechanism.

Further, it is not possible to fix the position of the opening/closing portion of the apparatus at any desired angle.

SUMMARY OF THE INVENTION

An object of the present invention is to provide an easily manufactured opening/closing mechanism of smaller size.

The present invention provides an opening/closing mechanism comprising a base attached to a main body of an apparatus; an arm attached to an opening/closing portion of the apparatus and axially supported on the base so as to turn freely; a rotary plate which turnes together with the arm and which has a projection; a pop-up plate having an engaging portion, wherein when the opening/closing portion is closed up to a prescribed position, the engaging portion engages with the projection of the rotary plate so that the pop-up plate turnes together with the rotary plate; and a resilient member provided between the pop-up plate and the base and compressed by turning of the pop-up plate, wherein the pop-up plate and the rotary plate are turned by this compressive force.

When the opening/closing portion of the apparatus is closed up to a prescribed position, the projection formed on the rotary plate in the opening/closing mechanism of the invention engages the engaging portion of the pop-up plate. When the opening/closing portion is completely closed by being pressed, the pop-up plate turns together with the rotary plate and is stopped at a prescribed position.

At this time the resilient member interposed between the pop-up plate and the base is compressed. When the opening/closing portion is released, the pop-up plate and the rotary plate are turned together by the compressive reaction force of the resilient member, thereby lifting the opening/closing portion.

EMBODIMENTS

Figure 1:
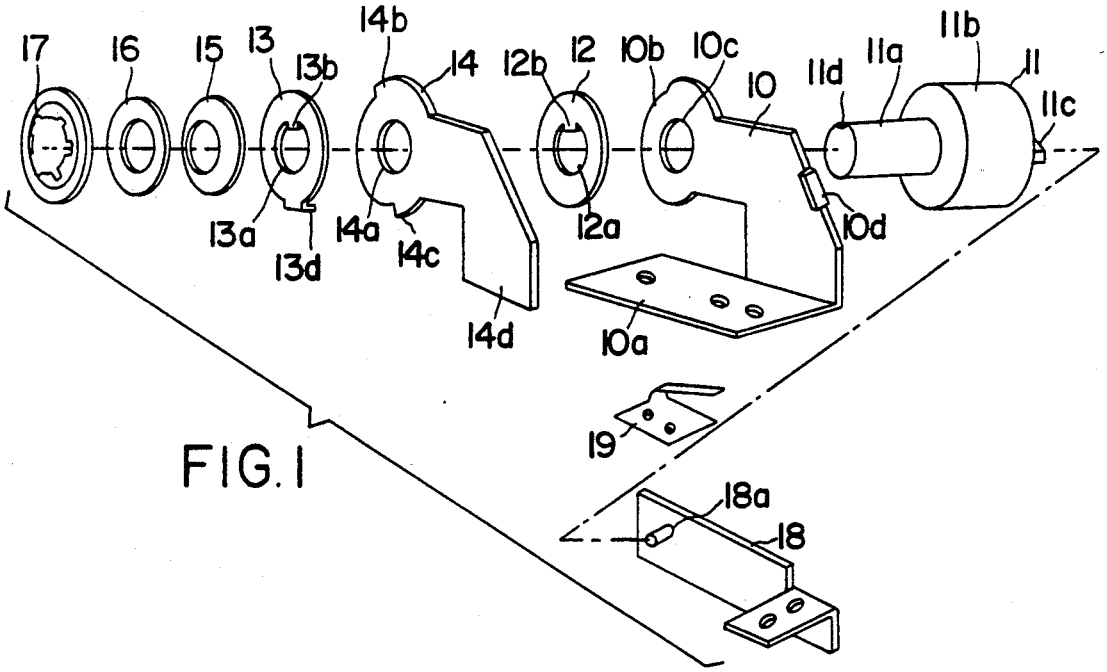
FIG. 1 is an exploded perspective view showing the construction of an opening/closing mechanism according to an embodiment of the present invention.
Figure 5:
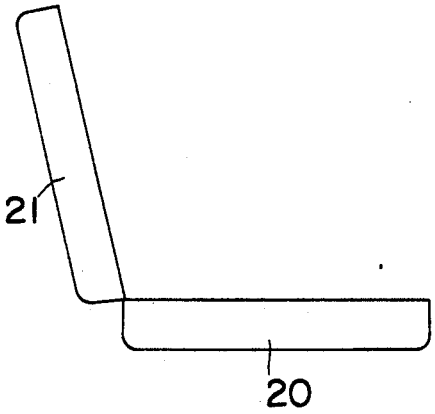
FIGS. 5 through 7 are diagrams showing the opening/closing operation of an apparatus, such as a personal computer, to which the opening/closing mechanism shown in FIG. 1 is attached.
Figure 6:
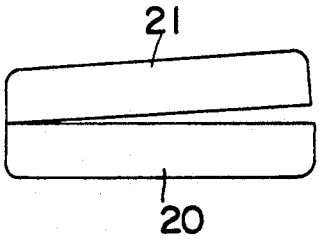
Figure 7:
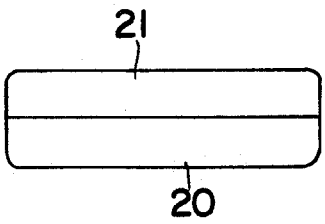

Referring now to FIG. 1, numeral 10 denotes a base attached to a main body 20 of an apparatus shown in FIGS. 5 to 7.

The base 10 has a mounting portion 10*a* attached to the main body 20, and a support portion 10*b* vertically upstanding from the mounting portion 10*a* and having a hole 10*c* at its center. Further, the support portion 10*b* has a stopper 10*d* which contacts a pop-up plate (described later) and is formed at the side face of the support portion 10*b*.

Numeral 11 denotes a shaft comprising a small-diameter portion 11*a* which matches the hole 10*c*, a large-diameter portion 11*b*, and a rectangular mounting portion 11*c* projecting from the end face of the large-diameter portion 11*b*. A linear groove 11*d* is formed at the outer periphery of the small-diameter portion 11*a* of shaft 11 and in the axial direction of the shaft.

Numeral 12, 13 denote first and second rotary plates each having the shape of a planar disk and holes 12*a*, 13*a* formed at the center thereof. Inwardly directed projections 12*b*, 13*b* matching the groove 11*d* of shaft 11 are provided at the inner peripheral portions of the holes 12*a*, 13*a*, respectively. Further, a projection 13*d* is provided at the outer peripheral portion of the second rotary plate 13 and bends to one side of the plate.

Numeral 14 denotes a pop-up plate having a hole 14*a* which matches the small-diameter portion 11*a*, first and second engaging portions 14*b*, 14*c* provided on its outer peripheral portion with a predetermined spacing between them, and an urging portion 14*d* projecting in the direction of the mounting portion 10*a* of base 10.

Numerals 15, 16 denote ring-shaped cup springs, and numeral 17 denotes a push nut attached to the tip of the small-diameter portion 11*a* of shaft 11. Numeral 18 denotes an arm attached to an opening/closing portion 21 such as the display portion of the apparatus shown in FIGS. 5 to 7. The arm 18 has a hole 18*a* which matches the mounting portion 11*c* of shaft 11.

Numeral 19 denotes a leaf spring serving as a resilient member. The leaf spring is fixed on the mounting portion 10*a* of base 10 and is disposed between the mounting portion 10*a* and the urging portion 14*d* of pop-up plate 14.

As shown in FIG. 1, when the small-diameter portion 11*a* of shaft 11 has been passed through the hole 10*c* of base 10, the parts constituted by the first rotary plate 12, pop-up plate 14, second rotary plate 13, cup springs 15, 16 and push nut 17 are assembled on the small diameter portion 11*a* in the order mentioned. These parts are fixed by the push nut 17 so as to be held in pressured contact under the spring force of the cup springs 15, 16. The arm 18 is attached to the mounting portion 11*c* of shaft 11 before and after the aforementioned parts are assembled.

The first and second rotary plates 12, 13 turn together with the shaft 11 since the projections 12*b*, 13*b* thereof are engaged with the groove 11*d* of shaft 11.

The first and second rotary plates 12, 13, the pop-up plate 14 and the support portion 10*b* of base 10 are alternately disposed and held in pressured contact by the cup springs 15, 16.

Consequently, a comparatively large force is required in order to turn the shaft 11 owing to the friction among these parts, and therefore it is possible to stop and fix the arm 18 at any angle.

It should be noted that it is possible to change the rotary torque of the shaft 11 at will by increasing or decreasing the number of rotary plates 12, 13 and the number of disk-shaped members clamped between them.

In addition, the projection 13*d* provided on the second rotary plate 13 is so arranged as to come into abutting contact with each of the engaging portions 14*b*, 14*c* of the pop-up plate 14 when the second rotary plate 13 is turned through a predetermined angle.

Next, the operation of the opening/closing mechanism shown in FIG. 1 will be described with reference to FIGS. 2 through 4 and FIGS. 5 through 7.

The arm 18 is attached to the shaft 11 in such a manner that the opening/closing portion 21 of the apparatus attains a widely open state, as shown in FIG. 5. In this state, the projection 13*d* of the second rotary plate 13 is contact with the second engaging portion 14*c* of pop-up plate 14, as shown in FIG. 2.

Figure 2:
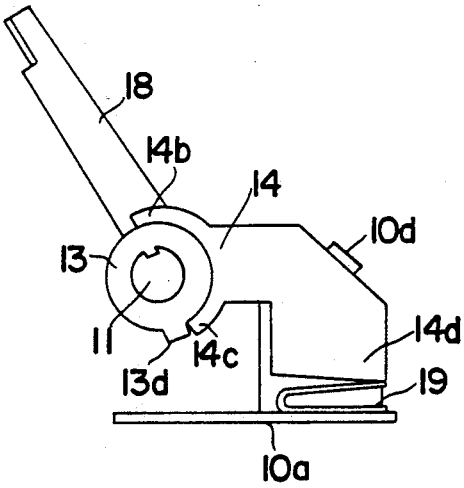
FIGS. 2 through 4 are diagrams showing the operation of the opening/closing mechanism illustrated in FIG. 1.

Since the arrangement is such that the outer face of the pop-up plate 14 comes into contact with the stopper 10*d* of base 10 under these conditions, rotation in the counter-clockwise direction in FIG. 2 is prevented.

Figure 3:
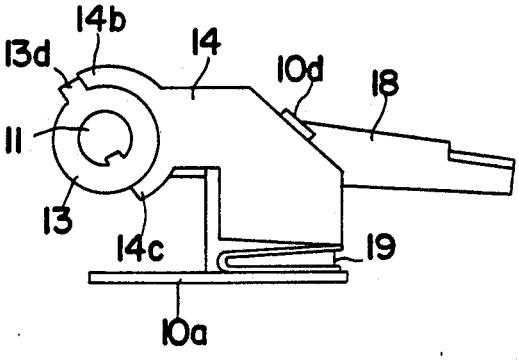

If the opening/closing portion 21 is reclined in the direction of the main body 20, the arm 18 rotates in the clockwise direction in the drawing, as illustrated in FIG. 3, and this is accompanied by rotation of the rotary plate 13 until its projection 13*d* abuts against the first engaging portion 14*b* of pop-up plate 14.

With the projection 13*d* of the second rotary plate 13 and the first engaging portion 14*b* of the pop-up plate 14 brought into abutting contact, the opening/closing portion 21 assumes a slightly open state, as illustrated in FIG. 6.

Figure 4:
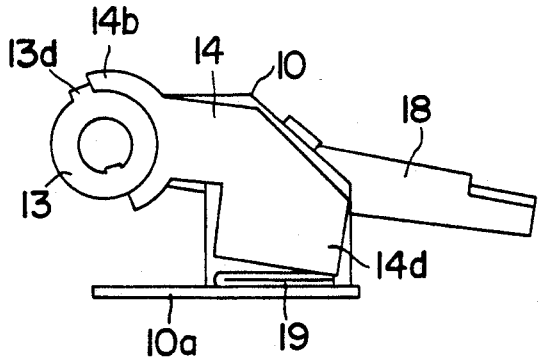

If the opening/closing portion 21 is now pressed to attain the state shown in FIG. 7, the second rotary plate 13 and the pop-up plate 14 engaging therewith will be rotated clockwise in the drawing, as shown in FIG. 4, owing to the rotation of the arm 18 at this time.

At this time the leaf spring 19 provided between the urging portion 14*d* of pop-up plate 14 and the mounting portion 10*a* of base 10 is compressed and adds a reaction force produced by the compression of the spring to the pop-up plate 14.

If the opening/closing portion 21 is released under these conditions, the pop-up plate 14 is rotated counter-clockwise by the force of the leaf spring 19, and the second rotary plate 13, whose projection 13*d* is engaging with the first projection 14*b* of the pop-up plate, also rotates in the counter-clockwise direction.

As a result, the arm 18 also rotates counter-clockwise and becomes the state shown in FIG. 3, and the opening/closing portion 21 becomes the state shown in FIG. 6.

In this embodiment, the opening/closing mechanism has a pop-up mechanism for opening the opening/closing portion slightly from the completely closed state and a tilt mechanism for fixing the opening/closing portion at any angle. It is possible to divide the pop-up mechanism and tilt mechanism.

For example, by omitting the cup springs 15, 16 and first rotary plate 12 from the opening/closing mechanism shown in FIG. 1, it is possible to provide the opening/closing mechanism having the pop-up action only.

Figure 8:
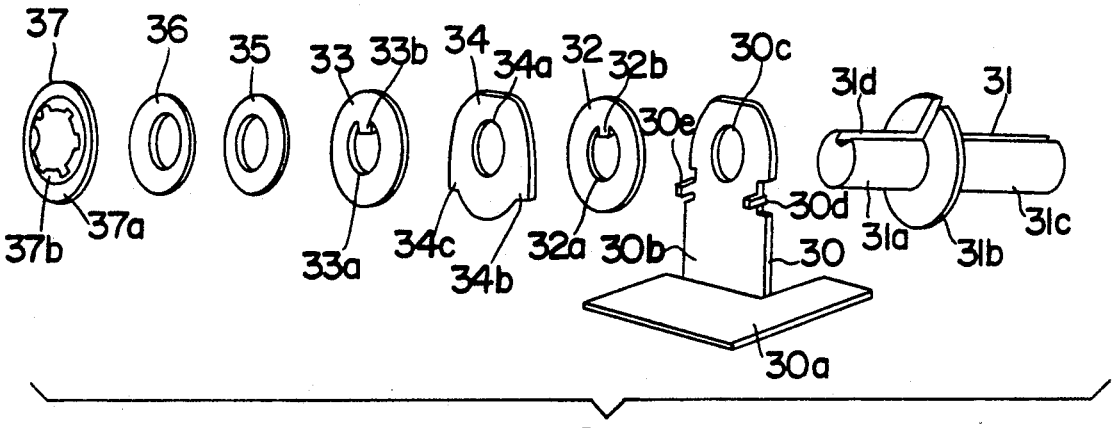
FIG. 8 is an exploded perspective view showing the construction of an opening/closing mechanism according to another embodiment of the present invention.
Figure 9:
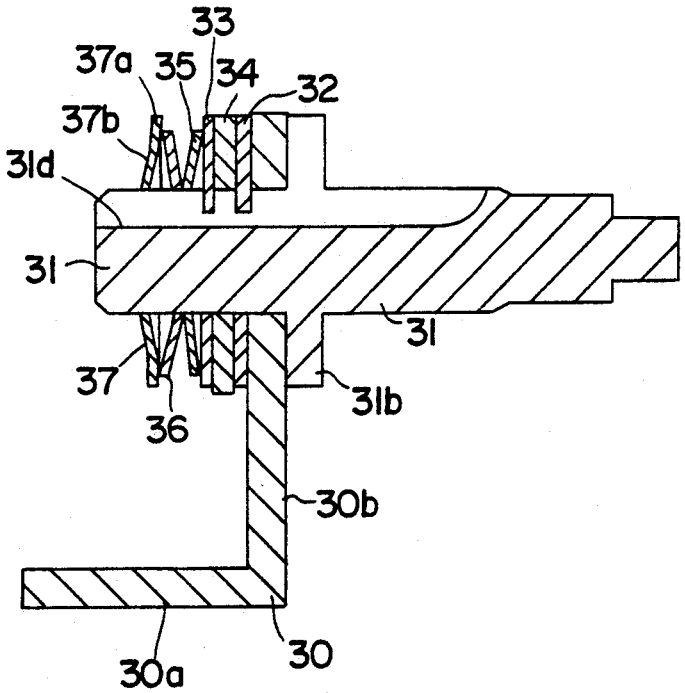
FIG. 9 is a sectional view of the opening/closing mechanism shown in FIG. 8.
Figure 10:
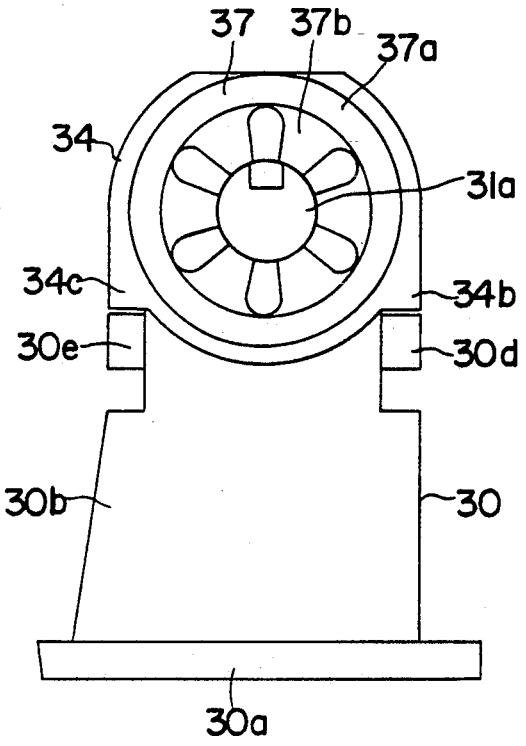
FIG. 10 is a side view of the opening/closing mechanism shown in FIG. 8.
Figure 11:
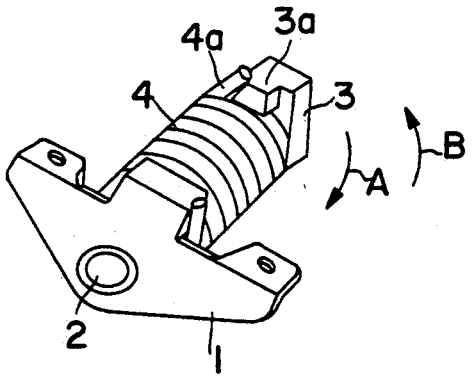
FIG. 11 PRIOR ART
FIG. 11 is a perspective view showing an opening/-closing mechanism according to the prior art.

Then, the opening/closing mechanism having the tilt action only will be described with reference to FIGS. 8 through 10.

Numeral 30 denotes a base attached to the main body of an apparatus such as a personal computer. The base 30 has a mounting portion 30*a* attached to the main body of the apparatus, and a support portion 30*b* vertically upstanding from the mounting portion 30*a* and having a hole 30*c* at its center. Further, stoppers 30*d*, 30*e* is provided at the side face of the support portion 30*b* and contact a fixed plate (described later).

Numeral 31 denotes a shaft comprising a small-diameter portion 31*a* which matches the hole 30*c*, a disk-shaped large-diameter portion 31*b* having a diameter larger than that of portion 31*a*, and a mounting portion 31*c* attached to an opening/closing portion of the apparatus via an arm or the like. Further, a linear groove 31*d* is provided at the outer periphery of the small-diameter portion 31*a* and in the axial direction of the shaft Numerals 32, 33 denotes first and second rotary plates each having the shape of a planar disk and having holes 32*a*, 33*a* at the center thereof. Inwardly directed projections 3*b*, 4*b* matching the groove 31*d* of shaft 31 are respectively provided at the inner peripheral portions of the holes 32*a*, 33*a*.

Numeral 34 denotes a fixed plate in the shape of a planar disk having a hole 5*a* which matches the small-diameter portion 31*a*, and engaging portions 34*b*, 34*c* provided on the outer peripheral portion for engaging with the stoppers 30*d*, 30*e* of the base 30.

Numerals 35, 36 denote ring-shaped cup springs.

Numeral 37 denotes a push nut comprising a ring-shaped rim portion 37*a*, and a plurality of locking pieces 37*b* projecting toward the center of the nut from the rim portion 37*a*.

As illustrated, the small-diameter portion 31*a* of the shaft 31 is passed through the hole 30*c* of base 30, and the abovementioned parts are mounted on the small-diameter portion 31*a* in the order of the first rotary plate 32, fixed plate 34, second rotary plate 33, cup springs 35, 36, and push nut 37.

The first and second rotary plates 32, 33 are mounted in such a manner that their projections 32*b*, 33*b* fit into the groove 31*d* of shaft 31, and therefore the rotary plates turn together with the shaft 31.

The fixed plate 34 is mounted in such a manner that its engaging portions 34*b*, 34*c* abut against the respective stoppers 30*d*, 30*e* of the base 30.

Further, the push nut 37 is fitted onto the outer periphery of the small-diameter portion 31*a* by being pushed from the end portion of the small-diameter portion 31*a* of shaft 31. The cup spring 36 is urged by the rim portion 37*a* of the push nut, and the locking portion 37*b* of the push nut bites into the outer periphery of the small-diameter portion 31*a*, whereby the push nut is fixedly attached on the small-diameter portion 31*a*.

In the mechanism thus assembled, the fixed plate 34 is arranged between the first and second rotary plates 32, 33, and these plates are sandwiched between the support portion 30*b* of base 30 and the push nut 37 to be brought into contact by a constant force.

As a result, a prescribed amount of friction is produced among these parts, thereby making it possible to stop rotation of the shaft 31 at any position.

ADVANTAGES OF THE INVENTION

In accordance with the invention, a coil spring is not used, and the leaf spring specifically for the pop-up plate is arranged at a location remote from the shaft. As a result, there is a large degree of freedom with regard to the shape of each part and the arrangement of the parts, and it is possible to reduce the size of the apparatus.

In particular, a structure in which disks are piled is adopted as a tilt mechanism, and both the second rotary plate and pop-up plate are constituted by plate members. As a consequence, it is possible to reduce dimentions in the axial direction of the shaft.

In addition, since the various parts are assembled merely by passing the shaft through them, manufacture is facilitated.

Furthermore, the arrangement is such that a small force is applied to the pop-up plate by the leaf spring at all times, thereby making it possible to prevent the occurrence of gap amoung the parts.

We claim:

1. An opening/closing mechanism comprising:

a base attached to a main body of an apparatus;

an arm attached to an opening/closing portion of said apparatus and axially supported on said base so as to turn freely;

a rotary plate which turnes together with said arm and which has a projection;

a pop-up plate having an engaging portion, wherein when said opening/closing portion is closed up to a prescribed position, the engaging portion engages with the projection of said rotary plate so that said pop-up plate turns together with the rotary plate; and a resilient member provided between said pop-up plate and said base and compressed by turning of said pop-up plate, wherein when said opening/-closing portion is released, said rotary plate is turned together with said pop-up plate by a compressive reaction force, thereby turning said opening/closing portion up to a prescribed position.

2. An opening/closing mechanism according to claim 1, further comprising a shaft rotatably supported by said base, wherein said arm is attached to said shaft, and wherein said rotary plate and pop-up plate are rotatably supported by said shaft.

3. An opening/closing mechanism according to claim 2, wherein said shaft has a linear groove which is formed at an outer periphery thereof, and wherein said rotary plate has an inwardly directed projection engaged with said groove of said shaft.

4. An opening/closing mechanism according to claim 2, further comprising cup springs supported by said shaft and a push nut attached to the tip of said shaft to fix said rotary plate, pop-up plate and base by the pressure of said cup spring.

5. An opening/closing mechanism according to claim 1, wherein said resilient member comprises a leaf spring.

6. An opening/closing mechanism according to claim 1, wherein said base has a stopper which contacts said pop-up plate.

* * * * *